United States Patent [19]

Lee

[11] Patent Number: 4,554,207

[45] Date of Patent: Nov. 19, 1985

[54] STRETCHED-AND-BONDED POLYETHYLENE PLEXIFILAMENTARY NONWOVEN SHEET

[75] Inventor: Chi C. Lee, Richmond, Va.

[73] Assignee: E. I. Du Pont de Nemours and Company, Wilmington, Del.

[21] Appl. No.: 679,799

[22] Filed: Dec. 10, 1984

[51] Int. Cl.[4] ..... B32B 17/02

[52] U.S. Cl. ..... 428/288; 26/51; 28/240; 28/246; 428/397; 428/401

[58] Field of Search ..... 428/288, 397, 401; 26/51; 28/240, 246

[56] References Cited

U.S. PATENT DOCUMENTS

| | | | |
|---|---|---|---|
| 3,081,519 | 3/1963 | Blades et al. | 28/81 |
| 3,169,899 | 2/1965 | Steuber | 161/72 |
| 3,208,100 | 9/1965 | Nash | 18/1 |
| 3,406,033 | 10/1968 | Reitz | 117/7 |
| 3,408,709 | 11/1968 | Reitz | 26/51 |
| 3,442,740 | 10/1970 | David | 156/81 |
| 3,772,417 | 11/1973 | Vogt | 264/230 |
| 4,048,364 | 9/1977 | Harding et al. | 428/113 |
| 4,107,364 | 8/1978 | Sisson | 428/196 |
| 4,187,343 | 10/1979 | Akiyama et al. | 428/288 |

*Primary Examiner*—Marion E. McCamish

[57] ABSTRACT

Lightweight nonwoven sheets of polyethylene plexifilamentary film-fibril strands are made by a stretching-and-bonding operation in which the unit weight of the sheet is decreased in stages while at a temperature within 3° to 8° C. of the melting point of the polyethylene. The resultant sheet has a novel combination opacity, X-ray scattering and physical characteristics and is particularly suited for sterile packaging, lightweight envelopes and surgical drapes.

9 Claims, 4 Drawing Figures

STRETCHED-AND-BONDED POLYETHYLENE PLEXIFILAMENTARY NONWOVEN SHEET

BACKGROUND OF THE INVENTION

1. Field of the Invention

This invention relates to a lightweight nonwoven sheet of polyethylene plexifilamentary film-fibril strands. In particular, the invention concerns a particular sheet of this type which is made by a process that includes a specific hot-stretching step.

2. Description of the Prior Art

Nonwoven sheets made from plexifilamentary strands of polyethylene film fibrils are known in the art. Blades et al., U.S. Pat. No. 3,081,519, discloses flash spinning of plexifilamentary strands of polyethylene film fibrils. Steuber, U.S. Pat. No. 3,169,899 discloses depositing such strands onto a moving receiver to form a nonwoven sheet. Methods of assembling strands deposited from a plurality of positions are disclosed by Knee, U.S. Pat. No. 3,402,227. Improved methods for depositing flash-spun plexifilamentary strands and forming them into sheets are disclosed by Pollock et al., U.S. Pat. No. 3,497,918.

The aforementioned methods have proven technically useful and commercially successful in the manufacture of wide nonwoven sheets of polyethylene plexifilamentary film-fibril strands (e.g., Tyvek® spunbonded olefin, manufactured by E. I. du Pont de Nemours & Co.). However, sheet uniformity problems are encountered in the known manufacturing processes when the weight of the sheet per unit area is decreased by increasing the speed of the moving receiver. The problems are exacerbated when the throughout per flash-spinning position is increased. The sheet becomes more blotchy in appearance and uniformity decreases to the point that the sheet contains pinholes. Sheets with pinholes are inadequate in end-uses, such as sterile packaging, surgical drapes, and the like. Lighter weight sheets are desired but the prior-art methods are inadequate for producing such sheets.

Several methods are known in the art for bonding nonwoven sheets of polyethylene plexifilamentary film-fibril strands. These methods include hot-air bonding on a tenter frame, pressing between heated platens, bonding while restrained against a hot roll by a heavy blanket, calendering with hot rolls and point-bonding with embossed rolls. Several methods also have been disclosed for imparting stretch to such nonwoven sheets, as for example in the aforementioned Steuber patent at column 5 lines 37–67, in Reitz, U.S. Pat. No. 3,408,709 at column 2, lines 57–72 and in Reitz, U.S. Pat. No. 3,406,033 at column 5, line 64 through column 6, line 71. In addition, other general processes for stretching webs are disclosed, for example, by Nash, U.S. Pat. No. 3,208,100, Vogt, U.S. Pat. No. 3,772,417 and Akiyama et al., U.S. Pat. No. 4,187,343. Each of these stretching processes, however, when applied to wide nonwoven sheets of polyethylene plexifilamentary film-fibril strands, has certain shortcomings, such as nonuniformly and excessively shrinking the sheet width and adversely affecting various strength and barrier properties of the sheet.

The purpose of the present invention is to overcome the above-recited shortcomings of known processes and to provide a sheet which can be made at lower unit weight than can be made by known methods and can still possess a satisfactory balance of barrier and properties.

SUMMARY OF THE INVENTION

The present invention provides a wide, lightweight, bonded, nonwoven sheet of polyethylene, plexifilamentary film-fibril strands having a unit weight of no greater than 60 g/m$^2$, an opacity of at least 75% and a pattern of long wavelength X-ray scattering that is characterized by a Guinier plot of the logarithm of the intensity of the scattered X-rays (log I) versus the square of the scattering angle ($\epsilon^2$), which exhibits a ratio (R) of the slope at 0.005 square radians to the slope at 0.010 square radians of no more than 0.85, preferably less than 0.80. Preferred embodiments of the sheet of the invention weigh no more than 50 g/m$^2$, most preferably, less than 35 g/m$^2$, and have opacities of at least 80%. In a preferred embodiment which is particularly suited for sterile packaging, sheets of the invention have a bacterial inhibition rate of at least 75% and most preferably at least 90%, and a Gurley-Hill permeability in the range of 0.8 to 4.8 sec/100 cm$^3$/cm$^2$.

The present invention also provides a process for preparing the above-described sheets. The process is of the type that includes the steps of forming a nonwoven sheet of flash-spun, polyethylene plexifilamentary film-fibril strands, lightly consolidating the thusly formed sheet and then longitudinally stretching the sheet. In the process of the present invention, the longitudinal stretching step is characterized in that the sheet is first heated without significant stretching to a temperature that is in the range of 3° to 8° C. below the melting point of the polyethylene. Then, while maintained at that temperature, the sheet is stretched in at least two stages to at least 1.20 times its original length prior to stretching, to provide a sheet weighing no more than 60 g/m$^2$. The heated-and-stretched sheet is then cooled to a temperature of less than 60° C., preferably by first cooling through one surface of the sheet and then through the opposite surface. The process is further characterized in that while the sheet is at a temperature above about 100° C., forces are applied perpendicular to the surface of the sheet to restrain the sheet from shrinking more than 10% in width. In a preferred embodiment of the process, the sheet is heated to a temperature in the range of 127° to 133° C., most preferably 128° to 132° C. and then is stretched in at least three and most preferably four stages at a stretch rate of no more than $2\times10^4$%/min., to 1.3 to 2.5, most preferably 1.5 to 2.0, times its original length. As a result of this hot-stretching treatment, the crystal morphology of the sheet is changed such that the Guinier plot slope ratio (R) of the sheet is reduced by at least 10%, preferably at least 15%.

BRIEF DESCRIPTION OF THE DRAWINGS

The invention will be further understood by reference to the attached drawings in which.

DETAILED DESCRIPTION OF PREFERRED EMBODIMENTS

Figure 1:
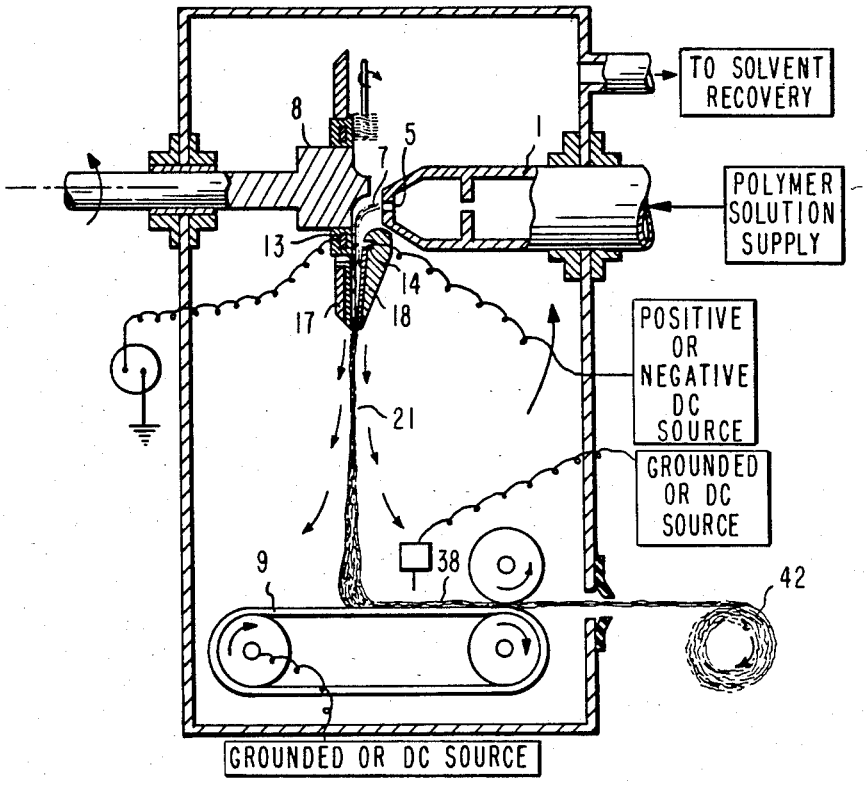
FIG. 1 is a schematic cross-sectional view of one position of a known flash-spinning apparatus that can be used for making nonwoven sheet of polyethylene plexifilamentary film-fibril strands, which sheet provides a starting material for the hot stretching-and-bonding step of the present invention.

The invention will now be described and illustrated in detail with respect to a preferred wide, lightweight, bonded nonwoven sheet of polyethylene plexifilamentary film-fibril strands (sometimes referred to hereinafter for simplicity as "plexifilamentary sheet") and to a preferred process for making the sheet. However, first, several terms will be defined to further aid in the understanding of the invention.

As used herein with regard to sheet of the present invention, "wide" means a width of at least 1.2 meters, preferably at least 2.5 meters; "lightweight" means a unit weight of no greater than 60 g/m$^2$, preferably no greater than 50 g/m$^2$, and most preferably no greater than 35 g/m$^2$; and "bonded" means bonded by heat without the addition of binders or adhesives to the sheet.

The term "polyethylene" is intended to embrace not only homopolymers of ethylene but also copolymers wherein at least 85% of the recurring units are ethylene units. The preferred polyethylene polymer is a homopolymeric linear polyethylene which has an upper limit of melting range of about 130° to 135° C., a density in the range of 0.94 to 0.98 g/cm$^3$ and a melt index (as defined by ASTM D-1238-57T, Condition E) of 0.1 to 6.0.

The plexifilamentary film-fibril strands of which the sheet of the invention is composed are of the type disclosed in Blades et al., U.S. Pat. No. 3,081,519. The film fibrils are very thin ribbon-like fibrous elements, which usually are less than 4-microns thick, as measured by interference microscopy. The film fibrils are interconnected and form an integral network within the plexifilamentary strand.

In its broadest aspect, the present invention provides a wide, lightweight, bonded nonwoven sheet of polyethylene plexifilamentary film-fibril strands, which sheet possesses a unique combination of opacity and crystal morphology. The opacity is at least 75%, preferably at least 80%. The morphology of the polyethylene crystals is indicated by a slope ratio, R, of a Guinier-plot. The construction of the Guinier plot from long wavelength X-ray scattering measurements and determination of the slope ratio, R, will be described in detail hereinafter.

The slope ratio, R, for sheet of the invention is usually no greater than 0.85 and preferably, no greater than 0.80. Usually the slope ratio is greater than 0.50. Applicant has found that the combination of opacity and slope ratio characterizes the manner in which sheet of polyethylene plexifilamentary film-fibril strand had been treated. For example, the present applicant found that when such sheet is stretched no more than to 1.2 times its original length, even if the sheet is treated in all other ways in accordance with the process of the present invention, the sheet has a slope ratio of greater than 0.85 and usually greater than 0.90. Similarly, the present applicant found that when a control sheet of the same kind is subjected to the same thermal history as sheet made in accordance with the present invention, except that the control sheet is not stretched, then the resultant control sheet has a slope ratio that is usually in the range of 0.9 to 1.0 or more. Sheet that has been neither bonded nor stretched has been found to have a slope ratio in the range of about 0.94 to 1.0. Sheet that has been stretched without heating, an operation usually limited to a 1.05 to 1.10 stretch because of the formation of tears and holes in the sheet at stretch factors much greater than 1.1, has been found to have a slope ratio of about 1.0. Sheet that has been bonded without stretching, in accordance with the known procedures of David, U.S. Pat. No. 3,442,740, has been found to have a slope ratio of about 1.0 or higher. Sheet that has been calendered, with or without heating, has been found to have a slope ratio in the range of about 0.45 to 0.65, but such sheet has an opacity of much less than 75%. Applicant knows of no nonwoven sheet of polyethylene plexifilamentary film-fibril strands that has been disclosed in the art and possesses the combination of an opacity of at least 75% and a slope ratio of no greater than 0.85, as possessed by the sheets of the present invention.

The unique combination of opacity and Guinier plot slope ratio of the sheets of the invention are accompanied by a desirable combination of strength, gas porosity and liquid barrier properties, as shown in Example II below, even when the sheets are of very light unit weight. For example, a sheet of the invention weighing as little as 27 g/m$^2$ can have tensile strengths in the longitudinal and transverse directions respectively, of 115 and 35 Newtons, delamination resistances of about 0.3 N/cm, Elmendorf tear strengths of about 4 Newtons and Mullen burst strengths of about 475 kPa along with hydrostatic heads of 150 cm, Gurley-Hill permeabilities of greater than 1.1 sec/100/cm$^3$/cm$^2$, and bacterial inhibition rates of greater than 83%. In sterile packaging applications that require in combination good porosity for ethylene oxide gas sterilization, high liquid-barrier properties and effective bacterial-inhibition rates, preferred sheets of the invention perform well when the sheets possess a Gurley-Hill permeability of no greater than 4.8, most preferably no greater than 3.2, but greater than 0.8 sec/100 cm$^3$/cm$^2$, a hydrostatic head of at least 150, most preferably at least 170 cm, and a bacterial inhibition rate of at least 80%, most preferably at least 85%. In contrast, sheets bonded by prior art processes, such as by the Palmer-bonding techniques of David, U.S. Pat. No. 3,442,740, have only about a 50% bacterial inhibition rate when the sheets have comparable gas permeabilities and weigh about 40 g/m$^2$. When Palmer-bonded plexifilamentary sheet weighs less than about 35 g/m$^2$, the bacterial barrier properties are completely inadequate. The bacterial inhibition rates of such sheets rapidly approach zero as the sheet weight is reduced to less than 30 g/m$^2$.

The starting material for preparing the hot stretched-and-bonded polyethylene plexifilamentary sheets of the present invention is prepared by the general methods disclosed by Steuber, U.S. Pat. No. 3,081,519. The preferred starting sheets are not bonded; the sheet is only lightly consolidated. However, a bonded sheet made in accordance with David, U.S. Pat. No. 3,442,740 can also sometimes serve as starting material for the process of the present invention.

To make the preferred nonbonded lightly consolidated starting sheets for the process of the present invention, a polymer of linear polyethylene having a density of 0.95 g/cm$^3$, a melt index of 0.9, as determined by ASTM method D-1238-57T, Condition E, and an upper limit of the melting range of about 135° C. is flash-spun from about a 12.5% solution of the polymer in trichlorofluoromethane. The solution is continuously pumped to spinneret assemblies at a temperature of 179° C. and a pressure above about 8610 kPa. The solution is passed in each spinneret assembly through a first orifice to a pressure let-down zone and through a second orifice into the surrounding atmosphere. The resulting film-fibril strand is spread and oscillated by means of a shaped rotating baffle, is electrostatically charged, and then is deposited on a moving belt. The spinneret assemblies are spaced to provide overlapping, intersecting deposits on the belt to form a batt. The batt is then lightly consolidated by passage through a nip that applies to the batt a compression of about 17.6 N/cm of batt width to form a lightly consolidated sheet, which serves as a preferred starting material for the stretching step of the present invention. Generally, such sheet having a unit weight in the range of 40 to 100 g/m$^2$ and a density in the range of 0.15 to 0.3 g/cm$^3$ is suitable for use in the present process. Preferably, the unit weight is in the range of 50 to 75 g/m$^2$.

An apparatus that is particularly suited for preparing preferred starting sheet for the hot stretch-and-bonding operation of the present invention is a flash-extrusion apparatus of the type disclosed in FIG. 1 of Bednarz, U.S. Pat. No. 4,148,595. As shown in that patent and in FIG. 1 herein, such a typical position generally includes a spinneret device 1, having an orifice 5, positioned opposite a rotating baffle 8, an aerodynamic shield comprised of members 13, 14, 17 and 18 located below the baffle and including corona discharge needles 14 and target plate 13, and a moving receiver surface 9 below the aerodynamic shield. A more detailed description of the apparatus is found in Bednarz at column 1, lines 67 through column 2, lines 64 and in Brethauer and Prideaux, U.S. Pat. No. 3,860,369 at column 3, line 41 through column 4, line 63, which descriptions are incorporated herein by reference. The rotating baffle 8 is lobed in accordance with the disclosure of Pollock and Smith, U.S. Pat. No. 3,497,918, the entire disclosure of which is incorporated herein by reference.

In operation of equipment of the type depicted in FIG. 1, a polymer solution is fed to spinneret device 1. Upon exit from orifice 5, the solvent from the polymer solution is rapidly vaporized and a plexifilamentary strand 7 is formed. Strand 7 advances in a generally horizontal direction to the rotating baffle 8 which deflects strand 7 downward into a generally vertical plane and through the passage in the aerodynamic shield. The rotating baffle, the action of the solvent gas and the effects of passage through the corona discharge field and the aerodynamic shield spread the strand into a thin, wide web 21 which is deposited on a moving receiver 9. The lobes of rotating baffle 8 impart an oscillation to plexifilamentary strand 7 so that the spread and deflected strand oscillates as it descends to the moving receiver. On receiver 9, the plexifilamentary web is deposited as a swath, which forms a ribbon that is combined with ribbons from other positions (not shown) to form wide sheet 38, which is then wound up as roll 42.

Figure 2:
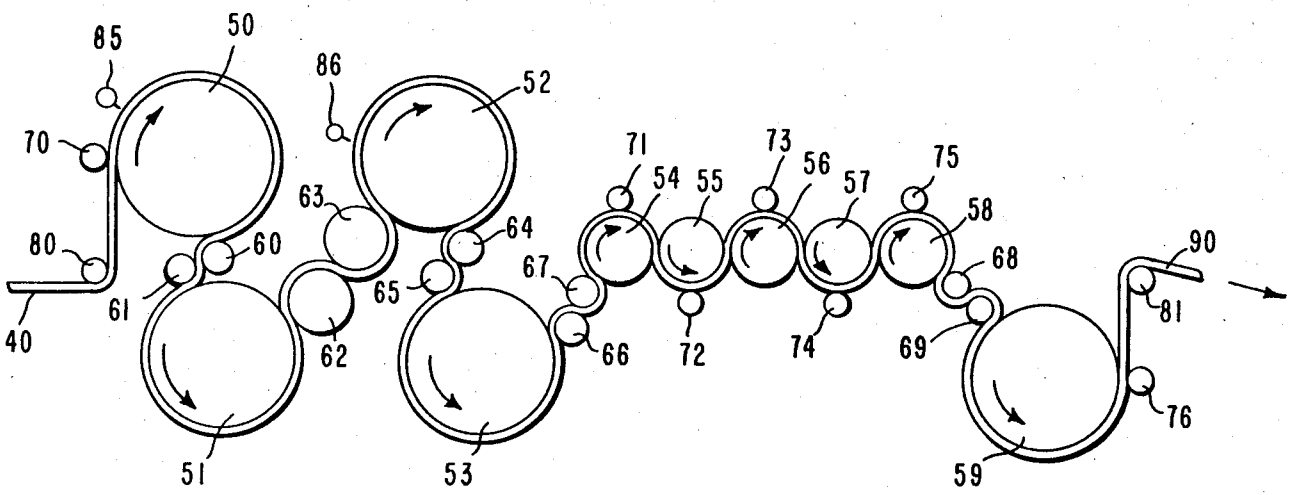
FIG. 2 is a flow diagram of a preferred embodiment of the hot stretching-and-bonding treatment of the invention.

In accordance with the present invention, a starting sheet, made as described above, is fed to a hot stretching-and-bonding step of the type depicted schematically in the flow sheet of FIG. 2 and described specifically in detail in Example I hereinafter. As shown in FIG. 2, starting sheet 40 is advanced over a series of rolls. The temperature of the sheet is raised from room temperature to the desired temperature of stretching by being passed in succession into contact with internally oil-heated, steel rolls 50,51,52 and 53. Then, while maintained at the desired temperature, the sheet is stretched while being passed into contact with internally oil-heated steel rolls 54,55,56 and 57. Rolls 50, 51,52, 53, and 54 operate so that substantially no stretch is imposed on the sheet by these rolls. "Substantially no stretch" means that in its passage from roll 50 to roll 54, the sheet is maintained under tension by operating each successive roll at a slightly faster surface speed, but no more than 1% faster, than that of the preceding roll. The speed of the sheet is then increased in passing from roll 54 to 55, from roll 55 to 56 and from roll 56 to 57 to provide three stages of stretch. Then, in succession, cooling is applied to one surface and then the opposite surface of the sheet by internally cooled steel rolls 58 and 59.

Cooling through one surface of the sheet and then through the opposite surface, as described in the preceding paragraph, is the preferred method of cooling in accordance with the invention because some polyethylene plexifilamentary sheets are prone to curling at the edges if cooled through only one surface. However, for sheets which can be cooled satisfactorily through only one face, roll 58 of FIG. 2 can be converted from a chilled roll to an heated roll. Then, roll 58 can function as another stretch roll, thereby converting the equipment of FIG. 2 from a three-stage to a four-stage stretching unit. In the cooling portion of the operation, whether with one or two cooling rolls, the temperature of the sheet is reduced to about 60° C. or lower.

During its passage from inlet idler roll 80 to exit idler roll 81, whenever the sheet is at a temperature of 100° C. or higher, forces are applied perpendicular to the sheet surface. As illustrated in FIG. 2, corona discharge wands 85 and 86 place an electrostatic charge on the sheet which causes an attractive force to hold the sheet in close contact with the heating rolls. Pairs of steel S-wrap rolls 60/61, 62/63, 64/65, 66/67 and 68/69 and rubber-coated nip rolls 70 through 76, as well as the tension placed on the sheet in its passage through the equipment, provide mechanical forces perpendicular to the sheet, which further aid in maintaining close contact of the sheet with the heating, stretching and cooling rolls. Such forces help restrain the sheet from shrinking excessively in the transverse direction during the operation. To further minimize shrinkage and improve the stretching uniformity, the paired S-wrap rolls are positioned to minimize the free, unrestrained length of the heated sheet (i.e., sheet at a temperature of at least 100° C.). The S-wrap rolls are positioned so that the distance from the point of tangency where the sheet leaves contact with a roll to the point of tangency where the sheet begins contact with the succeeding roll is no more than about 6 cm, but preferably no more than 2.5 cm. Such maximum distance can be obtained by maintaining the gap between successive rolls in the range of 0.13 to 0.33 cm. By maintaining the aforementioned forces and distances, sheet shrinkage can be kept to 10% or less.

To enhance the ease with which the heated polyethylene plexifilamentary sheet is released from the various steel heating and stretching rolls, the roll surfaces are coated with polytetrafluoroethylene.

The above-described heating-stretching-and-cooling operation not only increases the length of the sheet but also thermally bonds the sheet. During the operation, the sheet is heated to a temperature that is in the range of 3° to 8° C. below the melting point of the polyethylene of the plexifilamentary film-fibril strands. However, if the sheet is not heated sufficiently, and its stretching temperature is more than 8° C. below the polyethylene melting temperature, then, on stretching, holes or tears develop in the sheet. If the sheet is overheated and its stretching temperature is less than 3° C. below the polyethylene melting temperature, then, on stretching, the product becomes splotchy, less uniform, less opaque and less tear resistant. In addition, the overheated sheet tends to stick to the hot rolls. Thus, for a polyethylene having a melting point of 135° C., a suitable stretching temperature is in the range of 127° to 132° C. and the preferred stretching temperature is in the range of 128° to 131° C.

In operating the bonding-and-stretching step of the invention, roll speeds are controlled so that the stretching is accomplished in at least two stages, but preferably in three or four stages. Usually, each stage imposes the same percent longitudinal stretch to the sheet. The total stretch imparted is at least 1.2 times the original length of the sheet. Preferred total stretch is in the range of 1.3 to 2.5, with the range of 1.5 to 2.0 times the original length being most preferred. The speed of the sheet entering the bonding-and-stretching operation can be very low, from a technical viewpoint (e.g., 20 m/min or less). However, for economical reasons, much higher inlet speeds are employed, usually at least 30 m/min and preferably in the range of 50 to 150 m/min.

In addition to the above described ranges and limits on the operation of the hot stretching step of the present invention, there is also a practical upper limit on the rate at which the sheet may be stretched. The minimum stretch rate is a matter of simple economics. The upper limit on stretch rate depends on operating conditions. For example, at the upper stretching temperature and lower total stretch limits of the present process, the maximum stretch rate is about $2\times10^4$%/minute. At the lower stretching temperature and upper total stretch limits, the maximum stretch rate is about $5\times10^3$%/min. However, for ease and continuity of operation, stretch rates of no more than about one-third the maximum rate are usually employed. At stretch rates in excess of the above-quoted maxima, pinholes, tears or other gross nonuniformities frequently occur in the sheet. For calculating the stretch rate, stretching is assumed to occur only over the distance of sheet travel between successive nip rolls in a given stretching stage. For example, for the stretch stage represented in FIG. 2 by rolls 54 and 55, the stretching distance is measured from nip roll 71, along the surface of roll 54, thence from the point of tangency on roll 54 across the gap between rolls 54 and 55 to the point of tangency on roll 55 and thence along the surface of roll 55 to nip roll 72. The stretch rate in percent, r, is then calculated from the stretching distance and the peripheral velocities of successive stretch rolls by the following formula, in which. $V_1$ and $V_2$ are the velocities of successive stretch rolls ($V_2$ being faster than $V_1$) and S is the stretching distance between successive nips $$r=100(V_2-V_1)(V_2+V_1)/2V_1S.$$

The various sheet characteristics referred to herein are measured by the following methods. In the test method descriptions ASTM refers to the American Society of Testing Materials, TAPPI to the Technical Association of Pulp and Paper Industry and AATTC to the American Association of Textile Chemists and Colorists.

Figure 3:
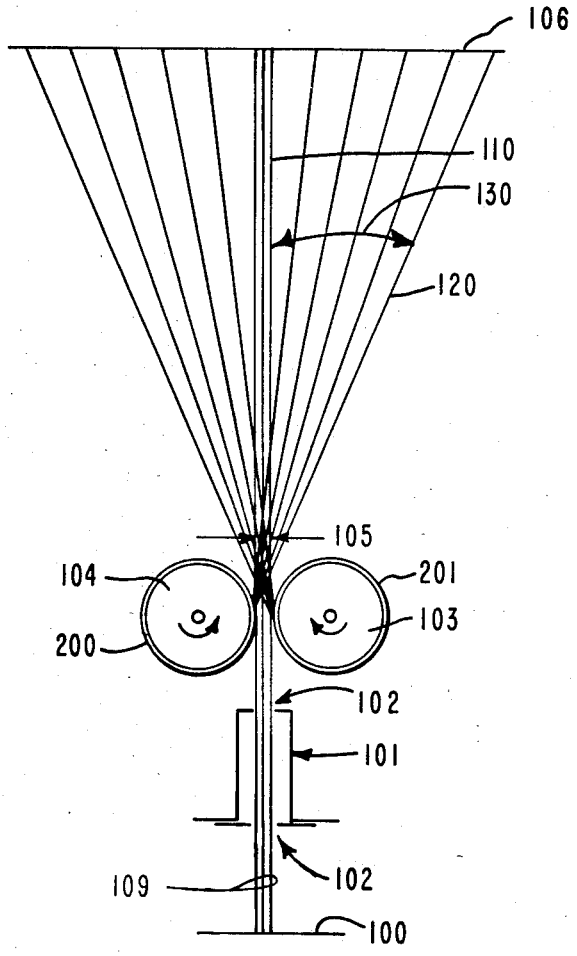
FIG. 3 is a schematic diagram of an instrument suitable for measuring long-wavelength X-ray scattering characteristics of the nonwoven sheets.
Figure 4:
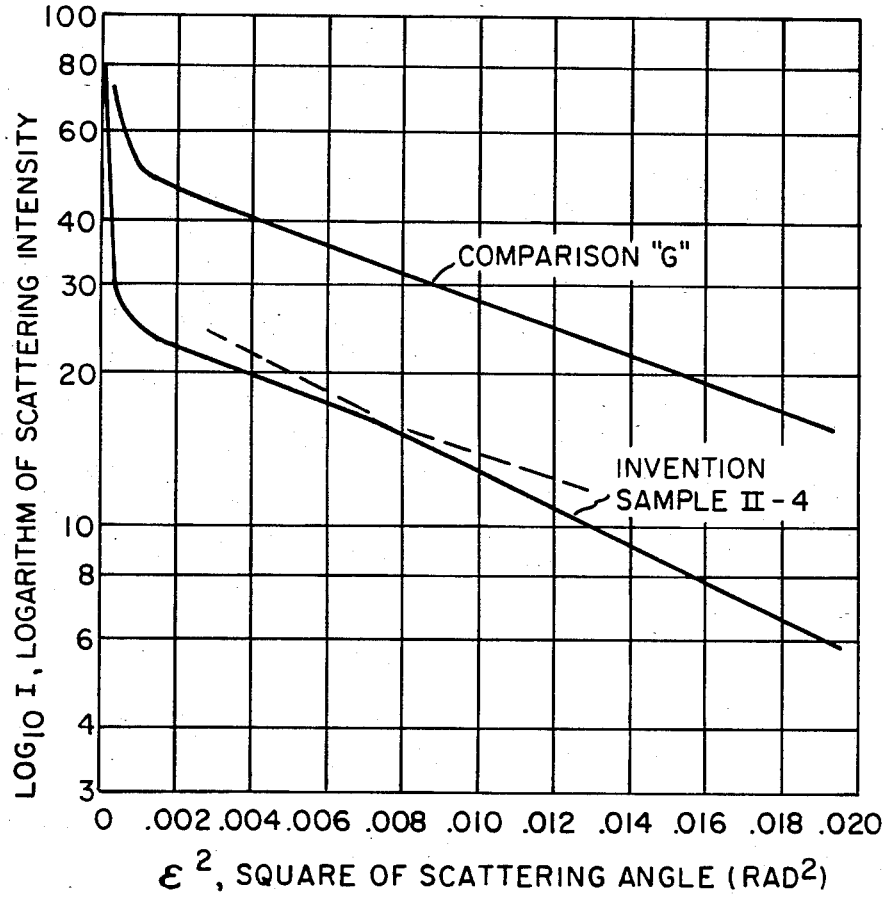
FIG. 4 is a semilogarithmic plot of scattering intensity (log I) as a function of the square of the scattering angle ($\epsilon^2$).

The slope ratio R is determined from a Guinier plot of long wavelength X-ray scattering measurements. The scattering measurements are made in accordance with the general method described by H. K. Herglotz in Chapter 6, "Long-Wavelength X-Ray Scattering to Study Crystal Morphology" of I. H. Hall (editor), "Structure of Crystalline Polymers," Elsevier Applied Science Publishers, New York, pages 229–260 (1984). An apparatus, as shown schematically in FIG. 3, is used. As shown in FIG. 3, carbon target 100 emits X-rays 109 of 44.7-Angstrom wavelength. The rays pass through collimator 101 via 0.09-cm-diameter pinholes 102. Counter-rotating rolls 103 and 104 are each of 1-cm diameter and are wrapped with sheet sample 200 and 201, such that the surfaces of the sheet are separated by a 0.038-cm gap 105. The primary beam 110 of the X-rays passes unscattered through the gap directly to recording film 106, while the other rays (e.g., ray 120) are scattered by different amounts. The angle designated 130, is the scattering angle, $\epsilon$, between primary beam 10 and scattered ray 120. Collimator 101 is 6.17-cm long and its axis, which is located directly in line with gap 105, is perpendicular to target 100 and recording film 106. The distance between the gap (i.e., position of closest approach of the sample surfaces) and the exit of the collimator is 2.0 cm and between the gaps and recording film is 15.0 cm. The X-ray scattering pattern developed on the film is evaluated by measuring with a densitometer the scattered intensity as a function of the scattering angle and then constructing a graph of the data in which the logarithm of the scattered intensity, $\log_{10}I$, is plotted versus the square of the scattering angle, $\epsilon^2$, in square radians. Such graphs, which are referred to herein as Guinier plots, are described by A. Guinier, "X-Ray Diffraction in Crystals, Imperfect Crystals and Amorphous Bodies," W. H. Freeman (1963). To determine the slope ratio R from the Guinier plot, the slope of the curve at 0.005 square radians is divided by the slope at 0.010 square radians. FIG. 4 shows two such plots; one is for a hot-stretched-and-bonded sheet of the invention which has a slope ratio of 0.64; and one is for a bonded-but-not stretched companion sheet which is outside the invention and has a slope ratio of 0.97. Note the distinct change in slope that occurs in the Guinier plot of the scattering data for the sheets of the invention in the region of $\epsilon^2$ equals 0.065 to 0.085 square radians.

Opacity is determined by measuring the quantity of light transmitted through individual 5.1-cm (2-in.) diameter circular portions of the sheet by employing an E. B. Eddy Opacity Meter, manufactured by Thwing Albert Instrument Company. The opacity of the sheet is determined by arithmetic averaging of at least fifteen such individual determinations. An opaque sheet has a measured opacity of 100%.

Unit weight is measured in accordance with TAPPI-T-410 OS-61 or by ASTM D3776-79 and is reported in $g/m^2$ herein.

Tensile properties are measured in accordance with TAPPI-T-404 M-50 or by ASTM D1117 and 1682-64 and is reported in Newtons herein in the longitudinal (MD) and transverse (XD) directions. Note that the tests are performed on 1-inch (2.54-cm) wide strips.

Delamination resistance is measured by using an Instron Tester, 2.5 cm×7.2 cm line contact clamps, and an Instron Integrator, all manufactured by Instron Engineering, Inc., Canton, Mass. Delamination of a 2.5 cm×17 cm specimen is started manually across a 2.5 cm×2.5 cm edge area at about the mid-plane of the sheet by splitting the sheet with a pin. The remaining 2.5 cm×15.3 cm portion of the sheet remains unseparated. The following settings are employed with a "C" load cell: Gauge length of 10.1 cm, crosshead speed of 12.7 cm per minute, chart speed 5.1 cm per minute, and full scale load of 0.91 kg. One end of one of the split layers is placed in each of the line clamps and the force required to pull the sheet apart is measured. Delamination resistance equals the integrator reading divided by the appropriate conversion factor which depends upon load cell size and units of measurement. Delamination is reported in Newtons/cm herein.

Elmendorf tear strength is measured in accordance with TAPPI-T-414 M-49 and is reported in Newtons herein.

Mullen burst strength is measured in accordance with ASTM D-1117-74 and is reported in kiloPascals herein.

Hydrostatic head is measured in accordance with AATCC 127-77 and is reported in centimeters.

Gurley-Hill permeability is measured in accordance with TAPPI-T-460 M-49 and is reported in sec/100 $cm^3/cm^2$ herein.

Bacterial inhibition rates, reported in percent, are measured in accordance with the test described by S. K. Rudys, "Barrier Properties of Spunbonded Medical Packaging Materials", Notes of TAPPI Conference "Disposable Sterile Packaging Seminar", held in Hilton Head, S.C. (1982), published by TAPPI press (Atlanta, Ga.).

Polyethylene melting point is defined as the upper temperature limit of the melting range as measured on a differential thermal analyzer operated with a heating rate of 10° C. per minute.

Sheets of the present invention are suitable as materials for use in many applications, such as sterile packaging, vacuum cleaner bags, bookcovers, envelopes, air-infiltration barriers for house construction, and the like. The desired properties can be obtained by careful adjustment of the temperature and the total stretch employed within the narrow ranges of the process of the present invention.

EXAMPLE I

In this example, a very light weight, bonded nonwoven sheet of polyethylene plexifilamentary film-fibril strands is prepared in accordance with the present invention by stretching a nonbonded, lightly consolidated, starting sheet to about 1½ times its original length in three continuous stages. The resultant sheet, though weighing less than 30 $g/m^2$, is of satisfactory strength, uniformity and appearance.

A 1.5-meter wide starting sheet was prepared by the general techniques of Steuber, U.S. Pat. No. 3,169,899, as described hereinbefore. Equipment, as depicted in FIG. 1, was employed to flash-spin linear polyethylene which has a melting point of 135° C., a melt index of 0.9 and a density of 0.95 $g/cm^3$ The starting sheet was fed to stretching equipment, the construction of which is shown schematically in FIG. 2. Operating conditions for the equipment are summarized in Table I, which lists the surface speed and temperature for each heating, stretching and cooling roll, as well as some surface temperatures of the sheet in various locations of the equipment.

TABLE I

Example I Operating Conditions

| Roll No. | Peripheral Speed m/min | Temperature, °C. Roll Fluid | Temperature, °C. Sheet Surface |
|---|---|---|---|
| 50 | 29.8 | 93.3 | 92.2 |
| 51 | 30.2 | 93.3 | — |
| 52 | 30.2 | 135.6 | 128.9 |
| 53 | 30.5 | 135.6 | — |
| 54 | 30.9 | 135.6 | 128.3 |
| 55 | 36.0 | 135.6 | — |
| 56 | 41.1 | 135.6 | 127.8 |
| 57 | 46.0 | 135.6 | — |
| 58 | 46.0 | 26.7 | 56.7 |
| 59 | 46.0 | <10. | 21.1 |

Sheet surface temperatures were measured by means of a hand-held pyrometer (e.g., an Ircon® infra-red pyrometer). Because of equipment space limitations such temperatures of the moving sheet were measured at only certain locations; namely, at positions, over rolls 50, 52, 54, 56 and 58, that were located 45° clockwise from vertical and a position over roll 59 just upstream of nip roll 76.

Corona discharge units 85 and 86, located just downstream of idler roll 70 and S-wrap roll 63 and about 2.5 to 3.2 cm above the surface of corresponding heating rolls 50 and 52, each operated at a voltage of 10 to 12 kilovolts d.c. and a current of about 300 microamps and electrostatically pinned the sheet to the rolls.

Each roll was positioned with respect to the next roll in the equipment so that the maximum distance that the sheet traveled freely and without contact with a roll, was no more than 2.5 cm. Each roll was 1.65-meters long. Roll diameters were: for heating rolls 50, 51, 52 and 53, and chill roll 59, 61.0 cm each; for stretch rolls 54, 55, 56 and 57 and cool roll 58, 20.3 cm each; for nip rolls 70, 71, 72, 73, 74, 75 and 76, and for S-wrap rolls 60, 61, 66, 67, 68 and 69, and idler rolls 80 and 81, 10.2 cm each; and for S-wrap rolls 62 and 63, 25.4 cm each. As a result of the positioning and speeds of the various rolls a maximum stretch rate of about 1800%/min was imposed upon the sheet.

As the starting sheet was passed through the stretching equipment, it was nominally stretched 1.17 times during passage from roll 54 to roll 55, then another 1.14 times during passage from roll 55 to roll 56 and finally another 1.12 times during passage from roll 56 to roll 57. Thus, the sheet was stretched to 1½ times its original length in three stages. The sheet experienced about 8% shrinkage in the transverse direction. The final sheet weighed about 28 $g/m^2$ and was flat and uniform in appearance. The sheet was well bonded, as indicated by its satisfactory tensile characteristics, its opacity of 78.6%, its average tear strength of 3.1 Newtons and its delamination strength of 0.33 N/cm. The Guinier plot for the sheet had a slope ratio of about 0.7.

EXAMPLE II

This example records the preparation of four stretched-and-bonded lightweight sheets of the invention. The sheets were prepared with equipment and starting sheets similar to those used in Example I. The stretching was done in four, approximately equal, stretch stages. Only one roll, roll 59, was used as a chill roll. Roll 58 was used as an additional heated stretch roll. Table II summarizes the conditions under which the equipment was operated and the properties of the resultant stretched-and-bonded sheets. The temperatures reported in Table II were the maximum surface temperatures experienced by the sheets during the hot stretching-and-bonding operation and the maximum temperature of the heating oil in the internally heated rolls.

TABLE II

| SHEET OF EXAMPLE II | Sample No. | | | |
|---|---|---|---|---|
| | II-1 | II-2 | II-3 | II-4 |
| Sheet Unit Weight, g/m$^2$ | | | | |
| Entering | 52 | 52 | 74 | 74 |
| Leaving | 27 | 34 | 42 | 47 |
| Stretch Factor | 1.93 | 1.54 | 1.74 | 1.56 |
| Sheet Speed, m/min | | | | |
| Entering | 24.3 | 30.5 | 30.5 | 31.3 |
| Leaving | 48.8 | 48.8 | 54.9 | 48.8 |
| Temperature, °C. | | | | |
| Oil | 138 | 138 | 138 | 138 |
| Sheet | 132 | 131 | 131 | 130 |
| Tensile Strength, N | | | | |
| MD | 117 | 115 | 201 | 197 |
| XD | 37 | 36 | 49 | 56 |
| % Elongation | | | | |
| MD | 5.3 | 6.9 | 8.7 | 8.3 |
| XD | 15.0 | 14.3 | 17.9 | 16.6 |
| Delamination, N/cm | 0.29 | 0.37 | 0.33 | 0.47 |
| Tear, N | 4.4 | 3.9 | 6.1 | 4.7 |
| Burst, kPa | 475 | 496 | 683 | 806 |
| Permeability, sec/100 cm$^3$/cm$^2$ | 1.1 | 1.4 | 1.9 | 1.6 |
| Hydrostatic Head, cm | 152 | 163 | 163 | 178 |
| Bacterial Inhibition, % | 83 | 92 | 83 | 96 |
| Opacity, % | 86 | 90 | 95 | 95 |
| Guinier Slope Ratio R | 0.73 | 0.72 | 0.65 | 0.64 |

EXAMPLE III

In this example the opacity and the long wavelength X-ray scattering Guinier-plot slope ratios of sheets of the invention are compared with those of sheets that have been bonded and/or stretched by techniques outside the invention. The comparisons are summarized in Table III wherein sheets of the invention are designated by Arabic and/or Roman numerals (the Roman numerals referring to the examples of this application) and comparison or control sheets, which are outside the invention bear alphabetic designations. All sheets are formed from polyethylene plexifilamentary film-fibril strands of the type used to prepare the sheets of Examples I and II. The stretching conditions listed in Table III represent the total stretch (expressed as a factor of the original sheet length) and the highest temperature experienced by the sheet during the stretching.

All samples of sheets of the invention, except sample 7, were made from non-bonded starting sheet. Sample 7 of the invention was prepared from a starting sheet that had been bonded at about 133° C. in a Palmer bonder in accordance with the general procedure of David, U.S. Pat. No. 3,442,740.

A wide variety of comparison sheets are included in Table III. Comparison "a" is an unbonded, lightly consolidated sheet which has received no treatment at all; it is the same type of material that is used as the non-bonded starting sheet for hot stretching-and-bonding operations in accordance with the invention. Comparison "b", is a lightly consolidated, non-bonded starting sheet that has been heated in air without stretching. Comparison samples "c" and "d" are lightly consolidated, non-bonded starting sheets that have been stretched at room temperature. Comparison samples "e", "f" and "g" are lightly consolidated, non-bonded starting sheets that have been bonded without stretching on equipment of the type shown in FIG. 2. Comparison samples "h" and "i" are lightly consolidated, non-bonded sheets that have been calendered between the rolls of a 25-ton ($2.2\times10^5$-Newton) calender. The remaining comparison samples "j" through "t" are examples of commercial Tyvek® spun-bonded olefin sheets, which are lightly consolidated, non-bonded starting sheets that have been bonded without stretching in a Palmer bonder, in accordance with the general procedures of David, U.S. Pat. No. 3,442,740. For Palmer-bonded commercial samples "j" through "p" the listed slope ratio is the average of the seven samples, whose individual slope ratios were 1.02, 1.42, 1.02, 1.31, 1.25 and 1.12, respectively. For Palmer-bonded samples "q", "r" and "s", the listed slope ratio is the average of the three individual slope-ratio is values of 1.06, 1.02 and 1.07 respectively.

As can be seen from the data summarized in Table III, except for calendered comparison samples "h" and "i", none of the comparison samples have Guinier plot slope ratios in the range of those of the present invention. However, note that the opacity requirements are completely lacking in the calendered samples "h" and "i".

TABLE III

| POLYETHYLENE PLEXIFILAMENTARY SHEETS OF EXAMPLE III | | | | | |
|---|---|---|---|---|---|
| | Unit | Stretching | | Guinier | |
| Sample No. | Weight g/m$^2$ | Total Stretch | Temp. °C. | Slope Ratio | % Opacity |
| I | 28 | 1.51 | 129 | 0.7 | 79 |
| II-I | 27 | 1.93 | 132 | 0.73 | 86 |
| II-2 | 34 | 1.54 | 131 | 0.72 | 90 |
| II-3 | 42 | 1.74 | 131 | 0.65 | 95 |
| II-4 | 47 | 1.56 | 130 | 0.64 | 95 |
| 5 | 42 | 1.74 | 131 | 0.52 | >85 |
| 6 | 47 | 1.56 | 129 | 0.80 | >85 |
| 7 | 27 | 2.0 | 132 | 0.77 | >85 |
| | | Comparison Sheets | | | |
| a | 52 | 1.0 | 25 | 0.99 | >85 |
| b | 42 | 1.0 | 131 | 1.00 | >85 |
| c | 71 | 1.05 | 25 | 1.05 | >85 |
| d | 39 | 1.10 | 25 | 0.98 | >85 |
| e | 42 | 1.0 | 135 | 1.00 | >85 |
| f | 52 | 1.0 | 131 | 1.00 | >85 |
| g | 42 | 1.0 | 129 | 0.97 | >85 |
| h | 52 | 1.0 | 43 | 0.65 | <60 |
| i | 52 | 1.0 | 100 | 0.43 | <60 |
| j-p | 75 | 1.0 | 133 | 1.2 | >80 |
| q-s | 61 | 1.0 | 133 | 1.05 | >80 |
| t | 42 | 1.0 | 133 | 1.0 | >80 |

What is claimed is:

1. In a wide, lightweight, bonded, non-woven sheet of polyethylene plexifilamentary film-fibril strands having a unit weight of no greater than 60 g/m2, the improvement comprising in combination, an opacity of at least 75% and a pattern of long wavelength X-ray scattering which is characterized by a Guinier plot of the logarithm of the intensity of the scattered X-rays versus the square of the scattering angle, said plot exhibiting a ratio of the slope at 0.005 square radians to the slope at 0.010 square radians that is no greater than 0.85.

2. A sheet of claim 1 wherein the sheet weighs no more than 50 g/m$^2$, the slope ratio is no greater than 0.80 and the opacity is at least 80%.

3. A sheet of claim 1 or 2 wherein the sheet weighs no more than 35 g/m$^2$.

4. A sheet of claim 1 or 2 wherein the sheet has a bacterial inhibition rate of at least 75% and a Gurley-Hill permeability in the range of 0.8 to 4.8 sec/100 $cm^3/cm^2$.

5. A sheet of claim 1 or 2 wherein the sheet weighs no more than 35 $g/m^2$, has a slope ratio of no greater than 0.75, an opacity of no less than 85%, a bacterial inhibition rate of at least 90%, a delamination strength of at least 0.3 N/cm, a Gurley-Hill permeability of at least 1.4 sec/100 $cm^3/cm^2$ and a hydrostatic head of at least 150 cm.

6. In a process for preparing a wide lightweight, bonded non-woven sheet of flash-spun polyethylene plexifilamentary film-fibril strands, which process includes the steps of forming a lightly consolidated, non-bonded sheet of such strands, the improvement comprising heating the formed sheet without significant stretching to a temperature that is in the range of 3° to 8° C. below the melting point of the polyethylene, then while being maintained at said temperature, stretching the sheet in at least two stages to at least 1.2 times its original length to provide a sheet weighing no more than 60 $g/m^2$, then cooling the sheet to a temperature of less than 60° C., and during the heating, stretching and cooling, while the sheet is at a temperature of at least 100° C., applying forces perpendicular to the surface of the sheet to restrain the sheet from shrinking transversely by more than 10%.

7. A process of claim 6 wherein the sheet is heated to a temperature in the range of 127° to 133° C. and then is stretched in no more than four stages at a stretch rate of no greater than $2\times10^4$%/min to 1.3 to 2.5 times its original length.

8. A process of claim 7 wherein the temperature is in the range of 128° to 132° C., the stretch rate is no greater than $5\times10^3$%/min and the resultant stretched sheet is between 1.5 and 2.0 times its original length.

9. A process of claim 6 or 7 wherein the cooling to a temperature of less than 60° C. is accomplished by applying the cooling first through one surface and then through the opposite surface of the sheet.

* * * * *